United States Patent [19]

Buckwalter et al.

[11] 4,357,189

[45] Nov. 2, 1982

[54] THROUGH-COLOR PRINTING

[75] Inventors: Mervin R. Buckwalter; Leonard N. Ray, Jr., both of Lancaster, Pa.

[73] Assignee: Armstrong World Industries, Inc., Lancaster, Pa.

[21] Appl. No.: 289,266

[22] Filed: Aug. 3, 1981

Related U.S. Application Data

[63] Continuation-in-part of Ser. No. 178,976, Aug. 18, 1980, abandoned.

[51] Int. Cl.[3] ..... D06P 5/20; C23C 11/00

[52] U.S. Cl. ..... 156/230; 156/236; 156/277; 156/298; 427/255.6; 8/491; 8/472

[58] Field of Search ..... 8/491, 471, 472; 156/230, 298, 231, 235, 308.2, 236, 238, 249, 289, 312, 231, 277; 264/522, 521, 344, DIG. 77; 101/470; 427/264, 270, 271, 244, 255.6

[56] References Cited

U.S. PATENT DOCUMENTS

| | | | |
|---|---|---|---|
| 791,503 | 6/1905 | Roehm | 427/264 |
| 3,093,867 | 6/1963 | Chandler | 8/491 |
| 3,868,214 | 2/1975 | Shackton | 101/470 |
| 3,879,816 | 4/1975 | Mouti | 101/470 |
| 4,007,003 | 2/1977 | Bulsou et al. | 8/472 |
| 4,018,557 | 4/1977 | Glover | 156/238 |
| 4,166,822 | 9/1979 | Hohmann et al. | 8/472 |

*Primary Examiner*—Edward C. Kimlin
*Assistant Examiner*—Louis Falasco

[57] ABSTRACT

A porous material is printed with a sublimable dyestuff designed to achieve substantial pattern depth penetration. After the porous fabric has been printed it is consolidated by compression and fusion to a desired degree. This then provides a product which has a through color printed effect.

3 Claims, No Drawings

THROUGH-COLOR PRINTING

CROSS REFERENCE TO RELATED APPLICATION

This application is a continuation-in-part of U.S. application Ser. No. 178,976 filed Aug. 18, 1980 abandoned in the name of Mervin R. Buckwalter et al. and entitled "Through-Color Printing."

BACKGROUND OF THE INVENTION

The invention is directed to a technique for printing a porous material, and more particularly, to the printing of a porous material followed by a consolidation of the material.

DESCRIPTION OF THE PRIOR ART

U.S. Pat. No. 4,007,003 is directed to a technique for printing a carpet with a sublimable dye.

U.S. Pat. No. 2,261,731 is directed to the printing of a sheet material while it is still absorptive of ink followed by a pressure application step which results in the surface becoming non-absorptive.

U.S. Pat. No. 791,503 is directed to a technique for applying pressure upon a sheet to cause pressure and heat to force ink into a surface while it is in a plastic state.

SUMMARY OF THE INVENTION

The method herein utilizes a gas-permeable non-woven web or foam which is then vapor-phase printed via a sublimable dye transfer process. The printed web or foam is compressed, consolidated, and/or fused to the degree desired. By controlling the temperature, pressure and time, varying degrees of consolidation can be achieved.

DESCRIPTION OF THE PREFERRED EMBODIMENT

The invention is directed to a process including the printing of a porous material with a sublimable dyestuff designed to achieve pattern depth in the range of 10 to 24 mils and greater. Such a result is achieved through the use of a gas-permeable non-woven web or foam which is vapor-phase printed after which the web is consolidated by compression and/or fusion to a desired degree. By controlling such factors as temperature, pressure and time during the consolidation step, products with graduated degrees of consolidation from top to bottom can be achieved.

In one specific example of the invention a piece of non-woven carpet approximately 3/16" thick is printed. The carpet is formed from 4" to 6" long staple, 16 denier polyester fiber which was conventionally needle bonded into a non-woven structure. It is needled into a PPG glass scrim. A transfer sheet such as Dexter Paper No. 1148-T is rotogravure printed with a sublimable dye and then the transfer paper is positioned against the non-woven carpet and the dye is transferred from the transfer sheet into the carpet using 40 standard cubic feet per minute per square foot of air heated to 410° F. Air flow is carried out for one minute to complete penetration of the dye through the non-woven carpet. The dye transfer process is similar to the process carried out in U.S. Pat. No. 4,007,003 and the dyes used here are the same as the dyes used in that patent.

Following the dying of the carpet, the carpet is then pressed at 430° F. for ½ minute at a pressure of 100 pounds per square inch to secure a product which has a final thickness of 25 mils. The pressing operation is such that the carpet fibers are consolidated and fused into a sheet structure of 25 mils thickness. The fiber structure is destroyed and the fibrous material is turned into a solid sheet of polyester material.

A series of three further samples were made utilizing an open cell urethane foam material which were printed. The urethane foam material utilized was GFI "Breakthru 150" carpet padding. Samples were formed using a ¼", ⅜" and ½" thick piece of the open cell urethane foam. The material was dyed utilizing the same printing process as described for the first example above given. Again, this printing process is conventional and utilizes conventional dyes as set forth in U.S. Pat. No. 4,007,003. After the printing has been carried out the individual three samples of ¼", ⅜" and ½" thickness were pressed for ½ minute at 400° F. and 100 pounds per square inch pressure. This yielded samples respectively with a thickness of 12, 18 and 24 mils. The pressing operation was such that the open cell urethane foam was consolidated into a sheet and fused as a sheet having the desired through color configuration. The cellular structure is destroyed, and the sheet formed is non-cellular and of solid urethane in cross-section. Naturally by varying the temperature pressure and applying time varying degress of consolidation can be achieved. Also as indicated above the thickness of the starting material can vary the thickness of the end product. When utilizing a non-woven or open cell structure the pressing operation will consolidate or reduce the thickness of the starting material and will form it into a non-porous sheet structure. As used herein, "consolidation" is not just compaction, but it is the forming of a solid non-cellular, non-porous mass from a porous, air containing material.

What is claimed is:

1. A process for forming a printed through color sheet structure comprising the steps of:
   (a) forming a non-woven or open cell foam porous base material,
   (b) preparing a transfer sheet with a sublimable dye thereon
   (c) transfer printing the sublimable dye from the transfer sheet to the non-woven or open cell base material to secure complete penetration of the dye through the porous base material, and
   (d) applying pressure to the base material to compress the base material, consolidate its porous structure into a non-porous structure and fuse the porous base material into a non-porous sheet material of about 1/20 the thickness of that of the original thickness of the base material, thereby there is formed a through color sheet material.

2. The process of claim 1 wherein the transfer sheet is placed adjacent the surface of the base material and heated air is passed through the transfer sheet and through the porous base material to vaporize the sublimable dye and to carry the sublimable dye from the transfer sheet through the base sheet to form a full penetration of dye through the base sheet.

3. The process of claim 1 wherein the material is consolidated at 100 pounds per square inch for ½ minute at about 400° F.

* * * * *